US010665989B2

(12) United States Patent
Suda et al.

(10) Patent No.: US 10,665,989 B2
(45) Date of Patent: May 26, 2020

(54) CONNECTOR INCLUDING A CATCHING PORTION THAT CATCHES AN ELASTIC LOCKING PORTION OF A MATING CONNECTOR, AND AN UNLOCKING MEMBER TO RELEASE THE ELASTIC LOCKING PORTION

(71) Applicant: JAPAN AVIATION ELECTRONICS INDUSTRY, LIMITED, Shibuyaku, Tokyo (JP)

(72) Inventors: Yuki Suda, Tokyo (JP); Yukitaka Tanaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/942,750

(22) Filed: Apr. 2, 2018

(65) Prior Publication Data

US 2018/0375252 A1 Dec. 27, 2018

(30) Foreign Application Priority Data

Jun. 26, 2017 (JP) ..... 2017-124539

(51) Int. Cl.
*H01R 13/627* (2006.01)
*H01R 13/633* (2006.01)
(Continued)

(52) U.S. Cl.
CPC ..... *H01R 13/6272* (2013.01); *H01R 13/6278* (2013.01); *H01R 13/6335* (2013.01);
(Continued)

(58) Field of Classification Search
CPC ..... H01R 13/6275; H01R 13/6272
(Continued)

(56) References Cited

U.S. PATENT DOCUMENTS 7,402,070 B1 * 7/2008 Wu ..... H01R 13/635 439/152
7,445,485 B1 * 11/2008 Wu ..... H01R 13/514 439/160
(Continued)

FOREIGN PATENT DOCUMENTS

CN 201797166 U 4/2011
CN 202662904 U 1/2013
(Continued)

OTHER PUBLICATIONS

Chinese Office Action (and English language translation thereof) dated Aug. 21, 2019 issued in counterpart Chinese Application No. 201810506807.0.
(Continued)

*Primary Examiner* — Tho D Ta
*Assistant Examiner* — Marcus E Harcum
(74) *Attorney, Agent, or Firm* — Holtz, Holtz & Volek PC

(57) ABSTRACT

A connector that is difficult to be released from a state fitted to a mating connector when an unexpected external force acts on the connector, and is removed from the mating connector with a small operating force when intentionally releasing the fitted state. An unlocking member of the connector for releasing this connector from the fitted state includes a releasing portion for releasing an elastic locking portion of the mating connector from a state caught by a catching portion of a connector body fitted to the mating connector, and a sliding portion for sliding on the connector body. The connector body includes a supporting portion for slidably supporting the sliding portion. A guide surface is formed on the supporting portion for guiding the sliding portion such that the releasing portion is displaced toward the elastic locking portion, to thereby release the caught state.

8 Claims, 15 Drawing Sheets

(51) Int. Cl.

| | |
|---|---|
| *H01R 13/508* | (2006.01) |
| *H01R 13/506* | (2006.01) |
| *H01R 12/72* | (2011.01) |
| *H01R 24/60* | (2011.01) |

(52) U.S. Cl.
CPC ..... *H01R 12/72* (2013.01); *H01R 12/721* (2013.01); *H01R 13/506* (2013.01); *H01R 13/508* (2013.01); *H01R 13/6275* (2013.01); *H01R 24/60* (2013.01)

(58) Field of Classification Search
USPC ..... 439/352, 353, 358, 607.2
See application file for complete search history.

(56) References Cited

U.S. PATENT DOCUMENTS

| | | | | |
|---|---|---|---|---|
| 7,540,755 | B1 * | 6/2009 | Wu | H01R 13/6275 439/352 |
| 8,475,199 | B2 * | 7/2013 | Wang | H01R 13/6335 439/160 |
| 8,480,432 | B2 * | 7/2013 | Wu | H01R 13/5812 439/353 |
| 8,905,777 | B2 * | 12/2014 | Zhu | H01R 13/62 439/352 |
| 9,496,645 | B2 | 11/2016 | Reed | |
| 9,590,355 | B2 | 3/2017 | Kawamura et al. | |
| 2006/0189197 | A1 * | 8/2006 | Reed | H01R 13/6275 439/352 |
| 2012/0052712 | A1 | 3/2012 | Wang et al. | |
| 2012/0190223 | A1 * | 7/2012 | Wu | H01R 13/633 439/152 |
| 2012/0218720 | A1 * | 8/2012 | Wu | H01R 13/6275 361/740 |
| 2014/0219616 | A1 | 8/2014 | Ishii et al. | |

FOREIGN PATENT DOCUMENTS

| | | |
|---|---|---|
| JP | 2016091606 A | 5/2016 |
| JP | 2016525772 A | 8/2016 |

OTHER PUBLICATIONS

Taiwanese Office Action (and English language translation thereof) dated Aug. 15, 2019 issued in counterpart Taiwanese Application No. 107112236.

* cited by examiner

CONNECTOR INCLUDING A CATCHING PORTION THAT CATCHES AN ELASTIC LOCKING PORTION OF A MATING CONNECTOR, AND AN UNLOCKING MEMBER TO RELEASE THE ELASTIC LOCKING PORTION

BACKGROUND OF THE INVENTION

Field of the Invention

This invention relates to a connector.

Description of the Related Art

Conventionally, there has been known an electric connector assembly 900 including an improved latch mechanism 906 shown in FIGS. 13 to 15 (see U.S. Pat. No. 8,905,777).

The electric connector assembly 900 includes a housing 901, a printed circuit board 903, the latch mechanism 906, a shielding member 905, and so forth. The latch mechanism 906 is capable of moving in a fitting direction D in which the electric connector assembly 900 is fitted to a receptacle connector 300, and a removing direction D' in which the electric connector assembly 900 is removed from the receptacle connector 300. The latch mechanism 906 includes an actuator 963 which is bent upward.

When the electric connector assembly 900 is fitted to the receptacle connector 300, a latching tab 301 of the receptacle connector 300 enters a fixing slot 1212 of the housing 901, and part of a free end of the latching tab 301 and an inner surface 1212A of the fixing slot 1212 are opposed to each other in the fitting direction D of the electric connector assembly 900.

Therefore, even when an external force in the removing direction D' of the electric connector assembly 900 acts on the electric connector assembly 900, the inner surface 1212A of the fixing slot 1212 catches a tip end of the latching tab 301, and hence the electric connector assembly 900 is prevented from being removed from the receptacle connector 300, whereby the electric connector assembly 900 and the receptacle connector 300 are acceptably maintained in the fitted state.

To pull out the electric connector assembly 900 from the receptacle connector 300, it is only required to pull a pull tape 961 of the latch mechanism 906 in the removing direction D' of the electric connector assembly 900. When the pull tape 961 of the latch mechanism 906 is pulled in the removing direction D' of the electric connector assembly 900, the actuator 963 pushes up the tip end of the latching tab 301, and the tip end of the latching tab 301 is released from the state caught by the inner surface 1212A of the fixing slot 1212, whereby the electric connector assembly 900 is removed from the receptacle connector 300.

The above-described electric connector assembly 900 suffers from the following problem.

Since the latch mechanism 906 includes the actuator 963, the tip end of the latching tab 301 is configured to be partially caught by the inner surface 1212A of the fixing slot 1212, and a catching range with which the inner surface 1212A of the fixing slot 1212 catches the tip end of the latching tab 301 (or an area of contact between the inner surface 1212A and the tip end of the latching tab 301) is small. Therefore, there is fear that when an unexpected external force in the removing direction D' of the electric connector assembly 900 acts on the electric connector assembly 900, the electric connector assembly 900 is easily removed from the receptacle connector 300 due to releasing of the inner surface 1212A of the fixing slot 1212 from the state caught by the tip end of the latching tab 301.

As the method of solving the above problem, a method is envisaged in which instead of causing the inner surface 1212A of the fixing slot 1212 to partially catch the tip end of the latching tab 301, the actuator 963 is configured to catch the tip end of the latching tab 301 in order to receive the external force in the removing direction D' of the electric connector assembly 900, and an angle is increased which is formed by a sloped surface of the actuator 963 and the fitting direction D of the electric connector assembly 900.

According to this method, it is considered that a catching range with which the sloped surface of the actuator 963 catches the tip end of the latching tab 301 becomes larger than the catching range with which the inner surface 1212A of the fixing slot 1212 catches the tip end of the latching tab 301, and the angle formed by the sloped surface of the actuator 963 and the fitting direction D of the electric connector assembly 900 is large, so that even when the unexpected external force in the removing direction D' of the electric connector assembly 900 acts on the electric connector assembly 900, the tip end of the latching tab 301 is made difficult to be released from the state caught by the sloped surface of the actuator 963.

The above method, however, can bring about a problem that when the electric connector assembly 900 is intentionally removed from the receptacle connector 300, the operating force required to be applied to the latch mechanism 906 is so large that the operability of the electric connector assembly 900 is degraded.

SUMMARY OF THE INVENTION

The present invention has been made in view of these circumstances, and an object thereof is to provide a connector that is difficult to be released from a state fitted to a mating connector when an unexpected external force in a direction of releasing the fitted state acts on the connector, and is removed from the mating connector with a small operating force when intentionally releasing the fitted state.

To attain the above object, the present invention provides a connector comprising a connector body that can be fitted to a mating connector including an elastic locking portion, and an unlocking member that is mounted on the connector body in a manner movable in a connector fitting direction and a connector removing direction, for releasing the connector from a state fitted to the mating connector, the connector body including a catching portion that catches the elastic locking portion, for maintaining the connector in the state fitted to the mating connector, wherein the unlocking member includes a releasing portion for releasing the elastic locking portion from a state caught by the catching portion, and a sliding portion for sliding on the connector body, wherein the connector body includes a supporting portion that slidably supports the sliding portion when the unlocking member is pulled in the connector removing direction, and wherein at least one of the supporting portion and the sliding portion has a guide surface formed thereon which is sloped such that the guide surface becomes closer to the elastic locking portion as the guide surface extends from a front side to a rear side of the connector body in the connector fitting direction, for guiding the sliding portion such that the releasing portion is displaced toward the elastic locking portion, to thereby cause the elastic locking portion to be released from the state caught by the catching portion.

Preferably, the supporting portion is located rearward of the releasing portion in the connector fitting direction, the unlocking member includes a hole for allowing the supporting portion to enter therethrough toward the elastic locking portion, and the sliding portion is located between the releasing portion and the hole in the connector fitting direction.

Preferably, the connector body includes a housing, and a shell that covers at least part of the housing, the shell has an opening for allowing the elastic locking portion to be received therein, and a rim of the opening of the shell forms the catching portion.

More preferably, the shell has a spring piece which is cantilevered and extends with respect to the opening from a rear side to a front side in the connector fitting direction, and is elastically deformed by being pushed by the releasing portion when the unlocking member is pulled in the connector removing direction, to thereby push out the elastic locking portion from the shell.

More preferably, the connector body includes an unlocking member-holding portion for holding the unlocking member on the housing in a manner movable in the connector fitting direction and the connector removing direction.

Preferably, the connector body includes a restricting portion which is located rearward of the supporting portion in the connector fitting direction, for restricting movement of the unlocking member in the connector fitting direction and the connector removing direction, and the unlocking member includes a restricting portion-receiving portion which is located rearward of the sliding portion in the connector fitting direction, for receiving the restricting portion.

Preferably, the guide surface is a flat surface.

According to the present invention, it is possible to provide a connector that is difficult to be released from a state fitted to a mating connector when an unexpected external force in the direction of releasing the fitted state acts on the connector, and is removed from the mating connector with a small operating force when intentionally releasing the fitted state.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing preferred embodiments thereof.

First, a description will be given of a connector 1 according to a first embodiment of the present invention, with reference to FIGS. 1 to 8.

Figure 1:
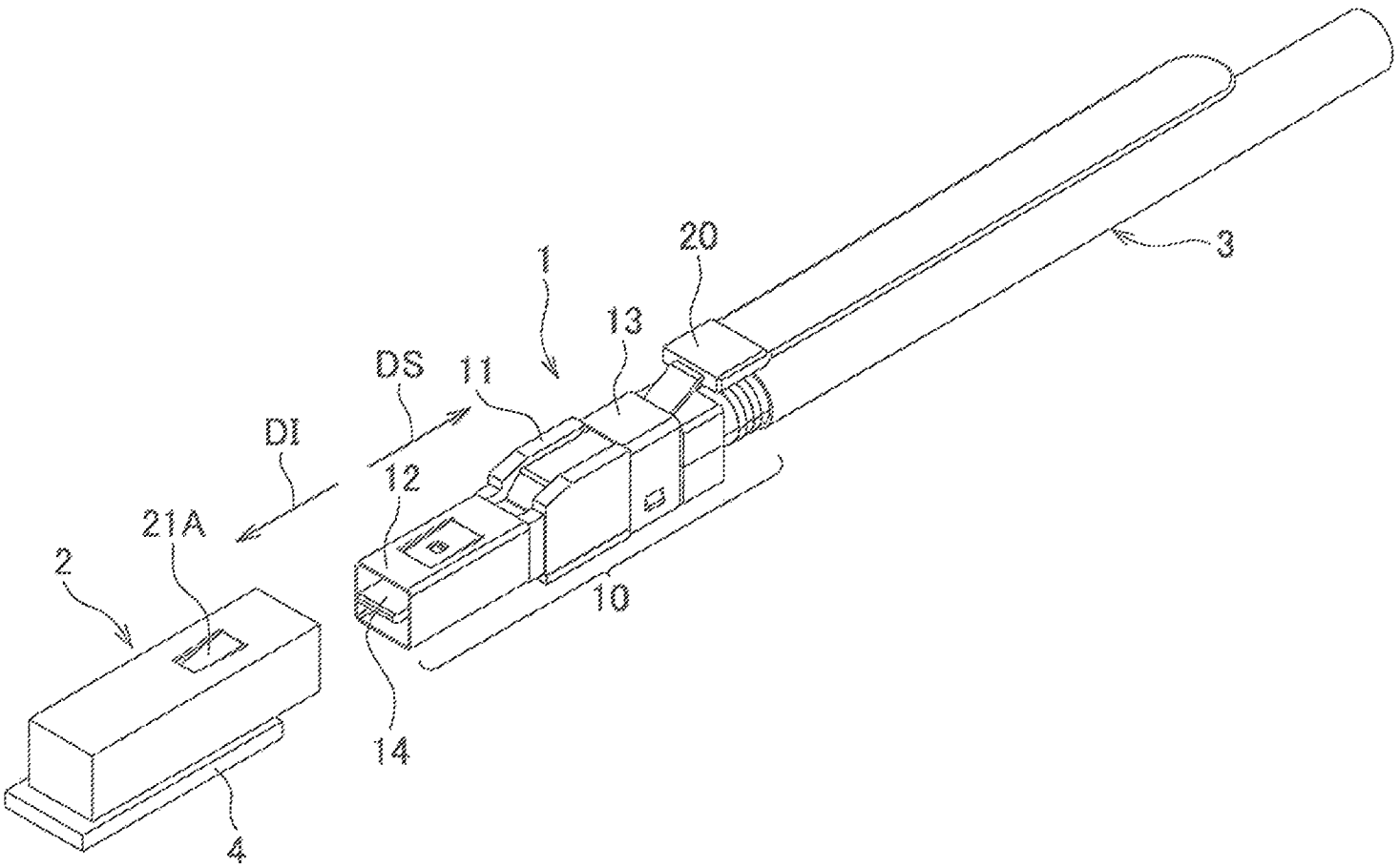
FIG. 1 is a perspective view of a connector according to a first embodiment of the present invention and a mating connector.
Figure 7:
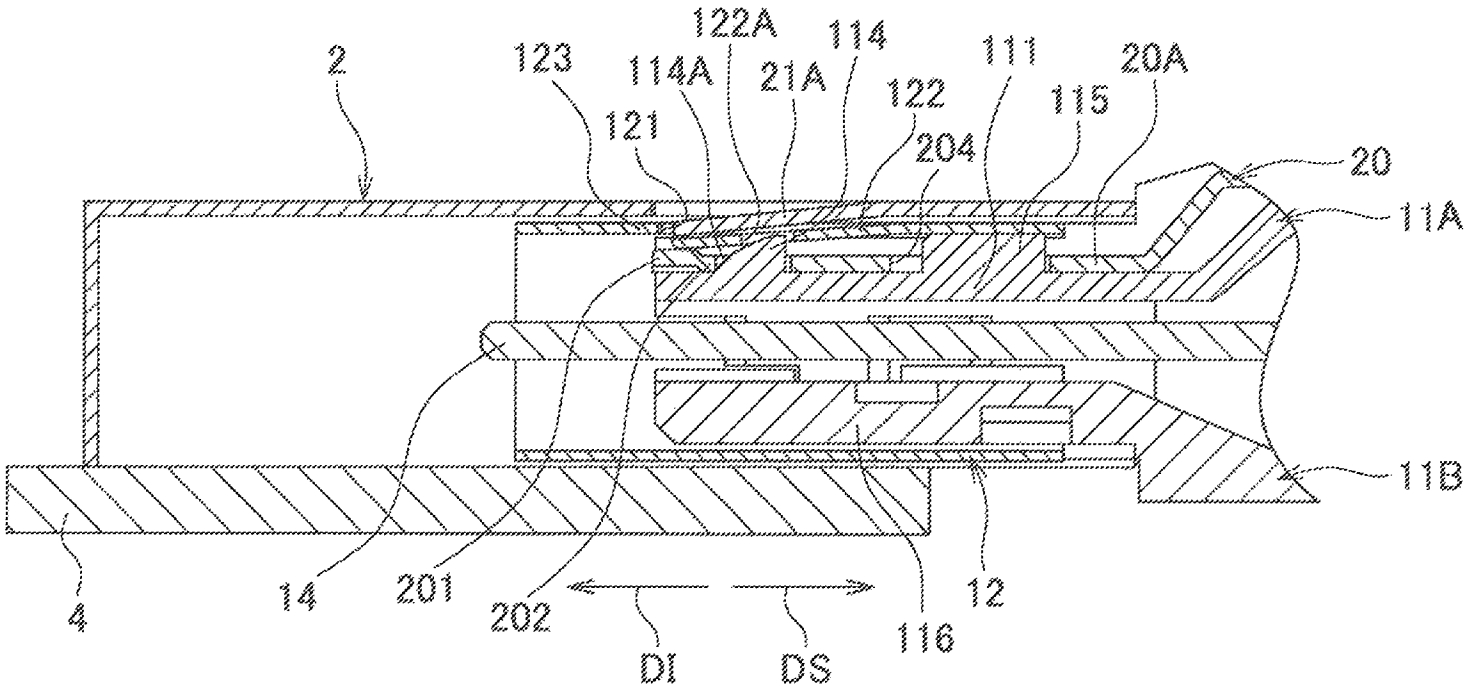
FIG. 7 is a partial enlarged cross-sectional view of the connector and the mating connector shown in FIG. 1 in a state fitted to each other, in which as for components of the mating connector, only the shell is shown and the others are omitted.

As shown in FIGS. 1 and 7, the connector 1 can be fitted to a mating connector 2 mounted on a printed circuit board 4. The connector 1 is connected to a cable 3.

The connector 1 includes a connector body 10 (see FIG. 1) fittable to the mating connector 2, and an unlocking member 20 for releasing the connector 1 from a state fitted to the mating connector 2.

As shown in FIG. 1, the connector body 10 includes a housing 11, a shell 12 for covering a tip end of the housing 11, an unlocking member-holding portion 13 for holding the unlocking member 20 on the housing 11 such that the unlocking member 20 can be moved in a connector fitting direction DI and a connector removing direction DS, and a printed circuit board 14 held by the housing 11.

Figure 2:
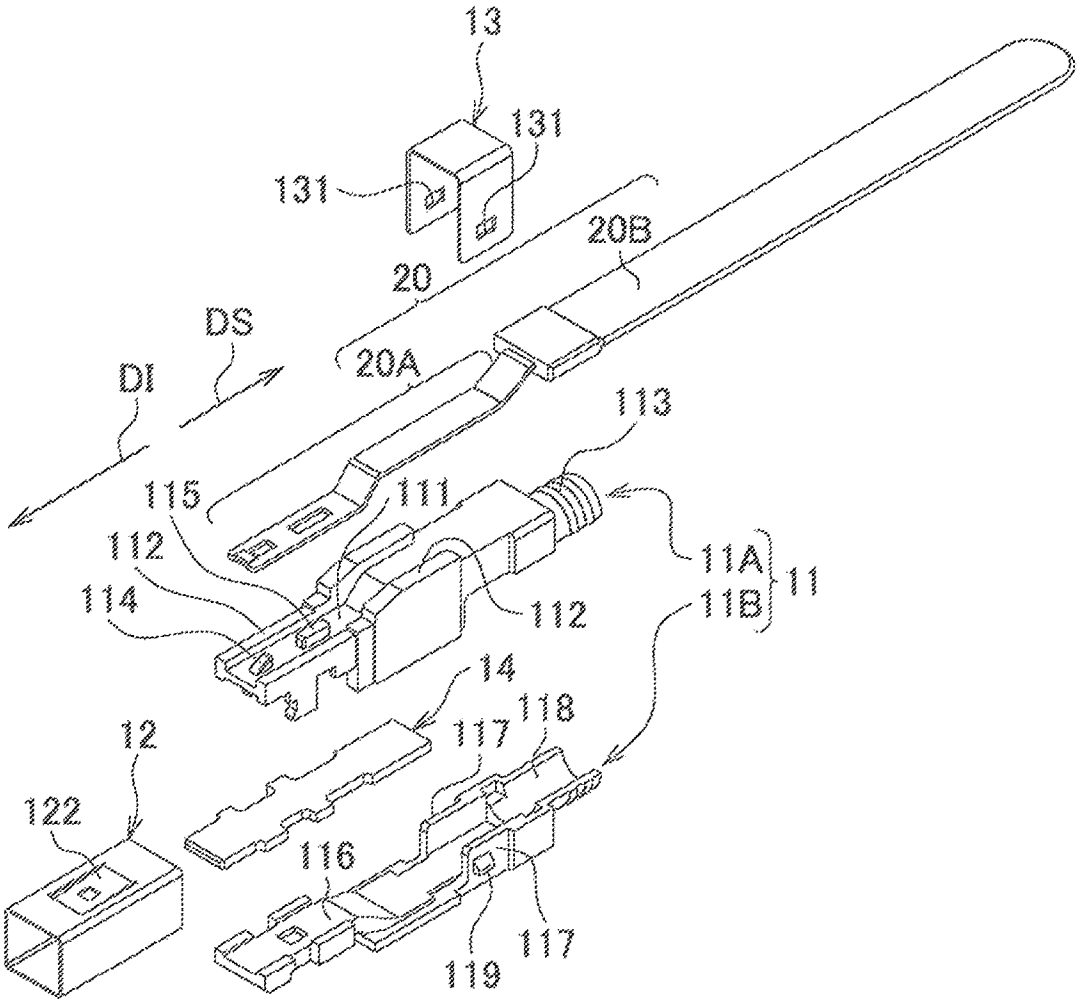
FIG. 2 is an exploded perspective view of the connector appearing in FIG. 1.
Figure 3:
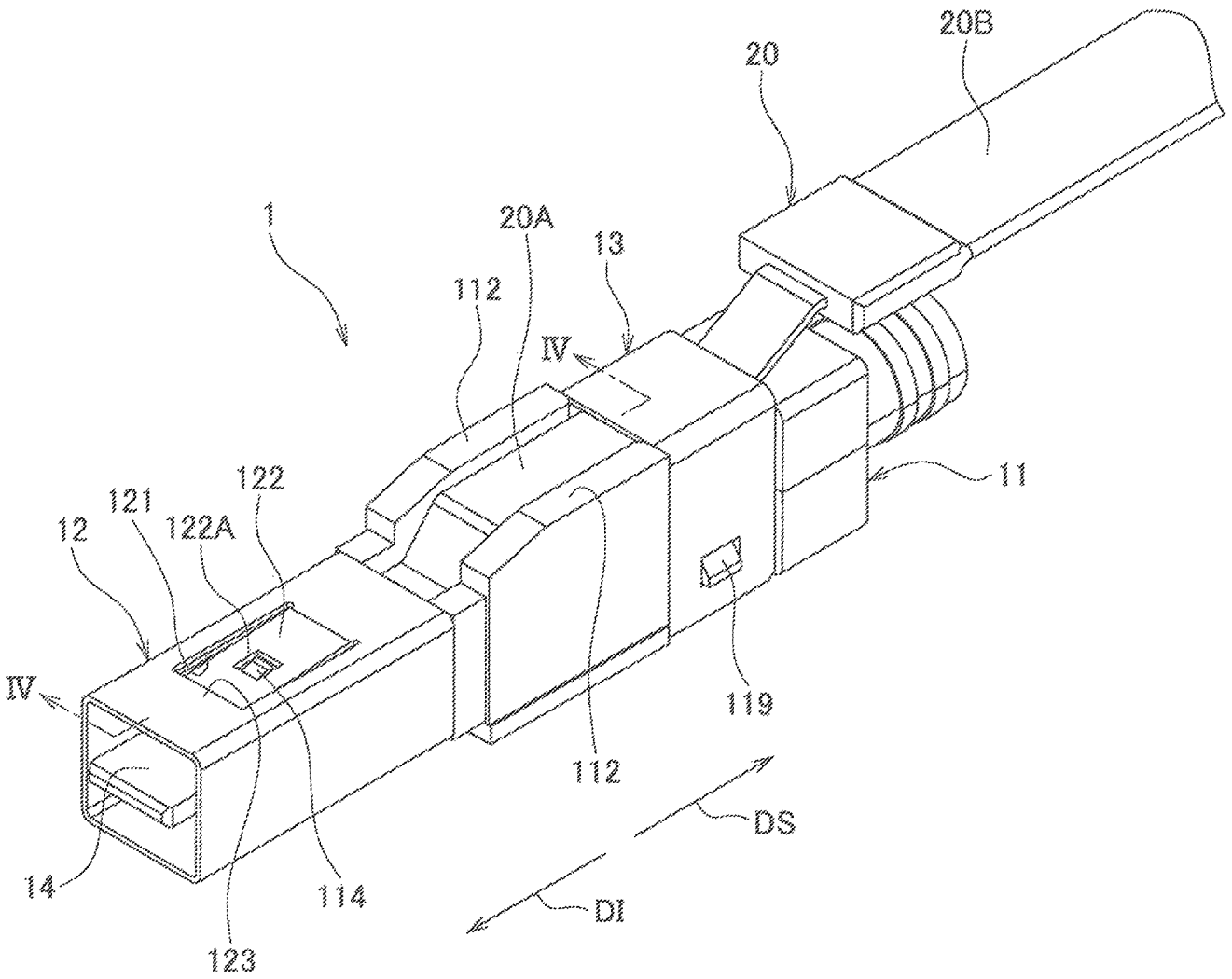
FIG. 3 is a partial enlarged view of the connector appearing in FIG. 1.
Figure 4:
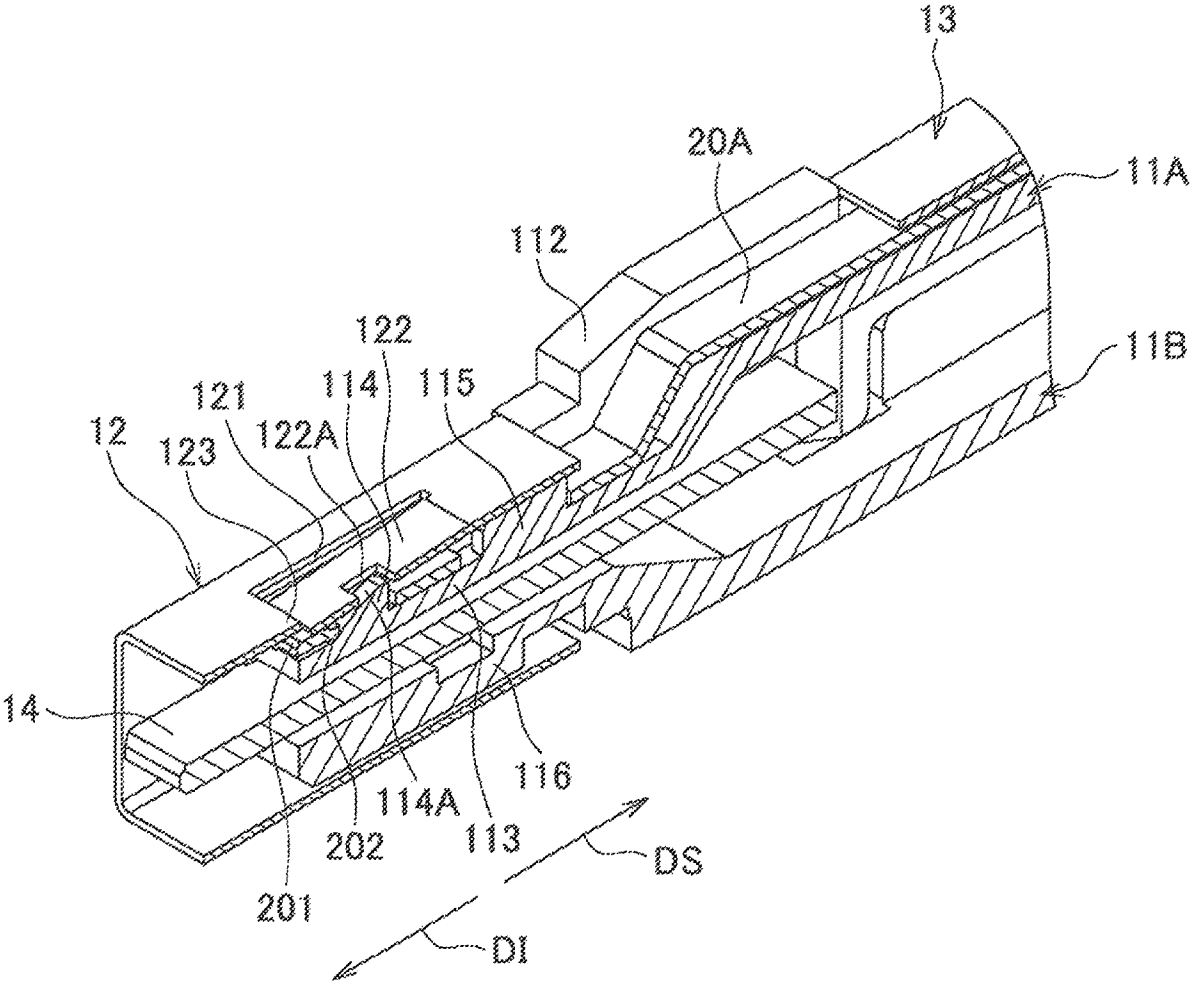
FIG. 4 is a cross-sectional view taken along IV-IV in FIG. 3.
Figure 5:
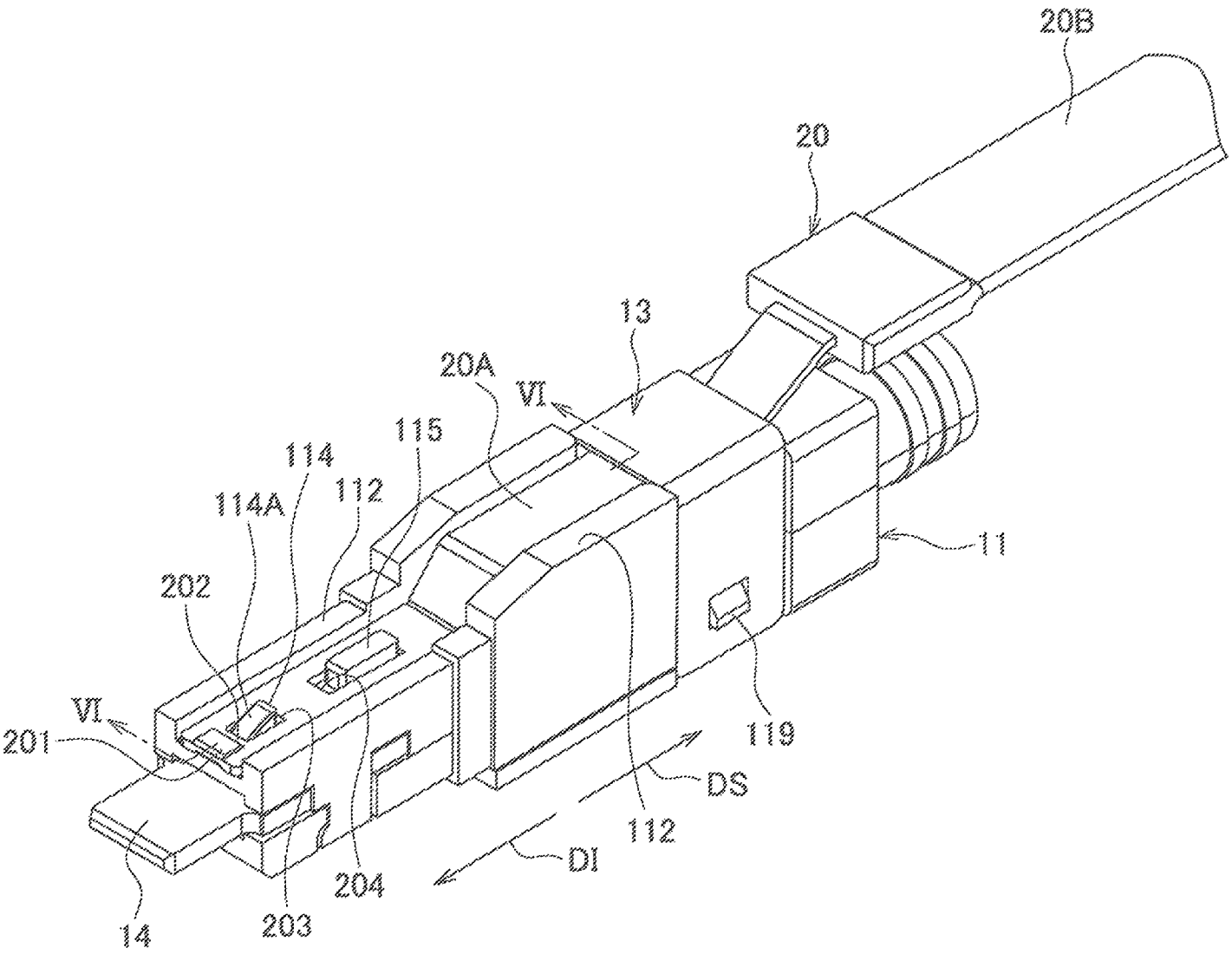
FIG. 5 is a perspective view of the connector appearing in FIG. 1 in a state in which a shell is removed therefrom.

As shown in FIG. 2, the housing 11 is comprised of an upper housing divided body 11A and a lower housing divided body 11B. The upper housing divided body 11A and the lower housing divided body 11B are made of metal, and hence they each have an electromagnetic shielding function.

The upper housing divided body 11A includes an upper wall portion 111, a pair of side wall portions 112, a cable supporting portion 113, a supporting portion 114, and a restricting portion 115. An unlocking member body 20A of the unlocking member 20 is disposed on the upper wall portion 111. The unlocking member body 20A is slidably sandwiched between the pair of side wall portions 112 (see FIG. 5).

The supporting portion 114 and the restricting portion 115 are formed on the upper wall portion 111. The supporting portion 114 and the restricting portion 115 protrude upward through holes 203 and 204, referred to hereinafter, of the unlocking member 20, respectively (see FIGS. 6 and 7). The restricting portion 115 is located rearward of the supporting portion 114 in the connector fitting direction DI. In an initial state (a state before the unlocking member 20 is pulled in the connector removing direction DS), the supporting portion 114 is located rearward of a releasing portion 201, referred to hereinafter, of the unlocking member 20 in the connector fitting direction DI (see FIGS. 4 to 7).

When the unlocking member 20 is pulled in the connector removing direction DS, the supporting portion 114 slidably supports a sliding portion 202 (see FIGS. 6 to 8), referred to hereinafter, of the unlocking member 20. The restricting portion 115 restricts the movement of the unlocking member 20 in the connector removing direction DS, and suppresses an excessive deformation of a spring piece 122, referred to hereinafter, of the shell 12. Further, the restricting portion 115 restricts the movement of the unlocking member 20 in the connector fitting direction DI, and prevents deformation and breakage of the unlocking member 20.

Figure 8:
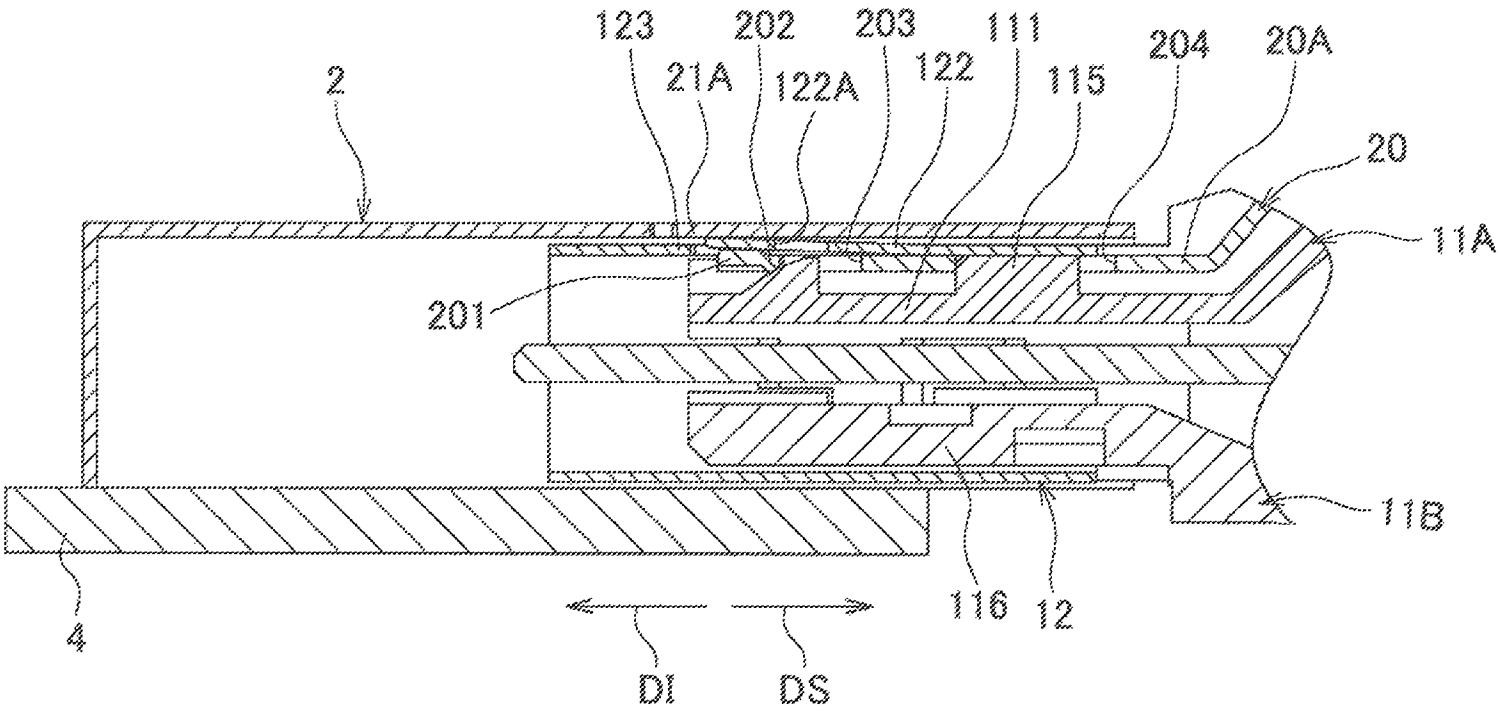
FIG. 8 is a cross-sectional view of the connector and the mating connector shown in FIG. 1 in a state in which an unlocking member is pulled in a connector removing direction, whereby an elastic locking portion is released from a state caught by a catching portion.

The supporting portion 114 is formed with a guide surface 114A which is sloped such that it becomes closer to an elastic locking portion 21A of the mating connecter 2 as the guide surface 114A extends from a front side to a rear side in the connector fitting direction DI, and guides the sliding portion 202 such that the releasing portion 201 is displaced toward the elastic locking portion 21A, to thereby cause the elastic locking portion 21A to be released from a state caught by a catching portion 123, referred to hereinafter, of the shell 12 (see FIGS. 7 and 8).

As shown in FIG. 2, the lower housing divided body 11B includes a lower wall portion 116, a pair of side wall portions 117, a cable supporting portion 118, and a pair of protrusions 119. The pair of protrusions 119 protrude outward from the pair of side wall portions 117, respectively. Only one protrusion 119 of the pair of protrusions 119 appears in FIGS. 2, 3, 5, and so forth.

The unlocking member-holding portion 13 is formed by bending an elastic metal plate into a U shape (see FIG. 2). The unlocking member-holding portion 13 includes a pair of holes 131 for receiving the pair of protrusions 119 of the lower housing divided body 11B. The pair of holes 131 are located at opposite ends of the unlocking member-holding portion 13. In a state where the upper housing divided body 11A and the lower housing divided body 11B are properly set, by mounting the unlocking member-holding portion 13 thereon, the pair of holes 131 of the unlocking number-holding portion 13 receive the pair of protrusions 119 of the lower housing divided body 11B, so that the upper housing divided body 11A and the lower housing divided body 11B are bound to each other. Further, the unlocking member-holding portion 13 restricts the movement of the unlocking member 20 in directions other than the connector fitting direction DI and the connector removing direction DS, and hence the operation of the unlocking member 20 is stabilized.

The printed circuit board 14 is formed with a plurality of conductive path portions, not shown. One end of each conductive path portion has an internal conductor, not shown, of the cable 3 soldered thereto. The printed circuit board 14 is sandwiched between the upper housing divided body 11A and the lower housing divided body 11B.

The shell 12 is formed by bending an elastic metal plate into a hollow prism shape (see FIG. 2). The shell 12 includes an opening 121 (see FIGS. 3 and 4) that allows the elastic locking portion 21A to be received therein, the spring piece 122 that is cantilevered and is elastically deformed by being pushed by the releasing portion 201 of the unlocking member 20 when the unlocking member 20 is pulled in the connector removing direction DS, to thereby push out the elastic locking portion 21A from the shell 12, and the catching portion 123 that catches the elastic locking portion 21A to maintain the connector 1 and the mating connector 2 in the fitted state.

The spring piece 122 extends with respect to the opening 121 from a rear side to a front side in the connector fitting direction DI. A rim of the opening 121 of the shell 12 forms the catching portion 123. The spring piece 122 is formed with a hole 122A for allowing a tip end of the supporting portion 114 to enter therethrough toward the elastic locking portion 21A (see FIGS. 3 and 7).

When the connector 1 is fitted to the mating connector 2, a free end of the spring piece 122 is located between the elastic locking portion 21A of the mating connector 2 and the releasing portion 201 of the unlocking member 20 (see FIG. 7), and hence when the unlocking member 20 is pulled in the connector removing direction DS, a position (power point) where the spring piece 122 receives force from the releasing portion 201 is far from a fixed end (support) of the spring piece 122. This makes it possible to suppress an increase in the operating force required to be applied to the unlocking member 20.

As shown in FIG. 2, the unlocking member 20 includes the unlocking member body 20A and an operation portion 20B. The unlocking member body 20A is formed by bending an elastic metal plate into a substantially crank shape. The operation portion 20B is made of resin. The operation portion 20B is connected to one end of the unlocking member body 20A. The unlocking member 20 is formed by the unlocking member body 20A and the operation portion 20B, and the operation portion 20B is easier to bend than the unlocking member body 20A. This improves the operability of the unlocking member 20.

Figure 6:
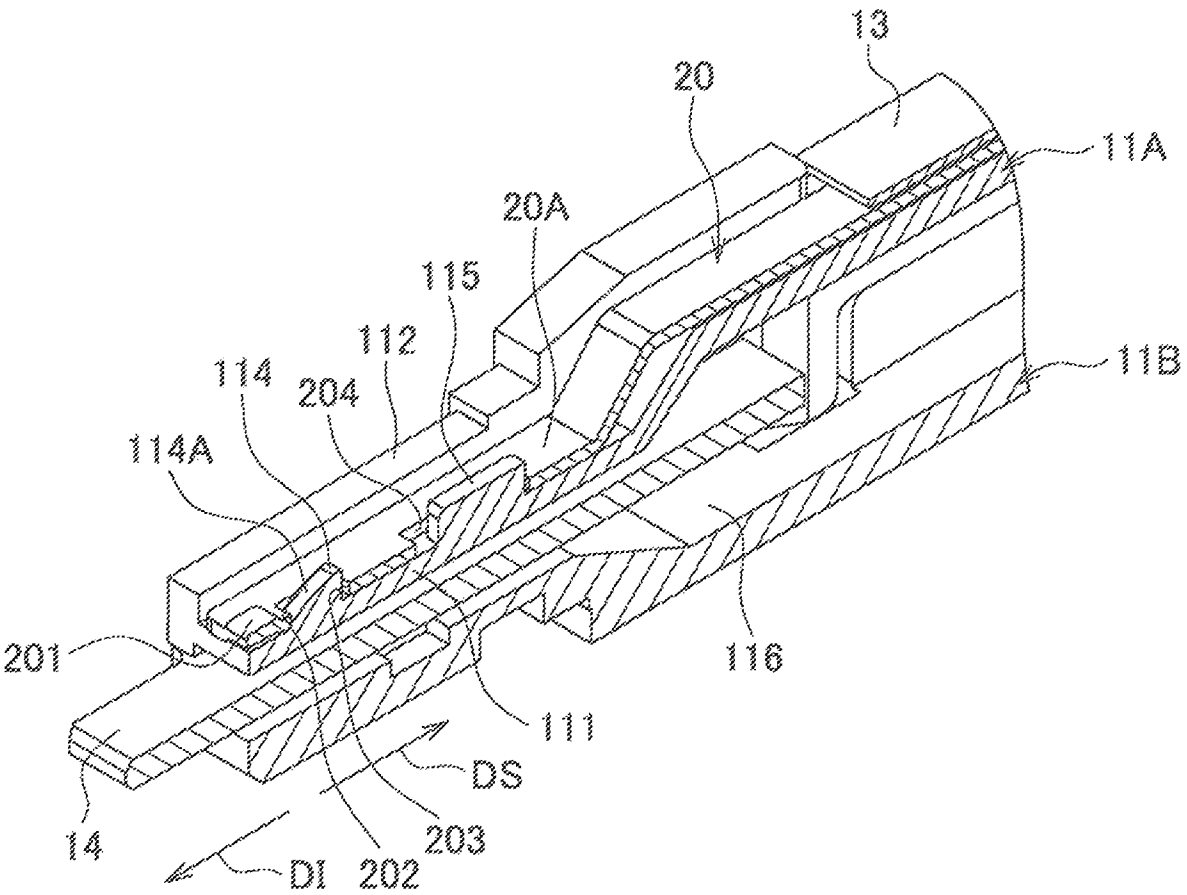
FIG. 6 is a cross-sectional view taken along VI-VI in FIG. 5.

As shown in FIGS. 6 and 7, the unlocking member body 20A includes the releasing portion 201 for releasing the elastic locking portion 21A of the mating connector 2 from the state caught by the catching portion 123 of the shell 12, and the sliding portion 202 for sliding on the housing 11 of the connector body 10. The releasing portion 201 is located forward of the sliding portion 202 in the connector fitting direction DI.

The unlocking member body 20A is formed with the hole 203 for allowing the supporting portion 114 to enter therethrough toward the elastic locking portion 21A of the mating connector 2, and the hole (restricting portion-receiving portion) 204 for receiving the restricting portion 115. The hole 203 is located rearward of the sliding portion 202 in the connector fitting direction DI.

Next, a description will be given of how to assemble the connector 1.

First, the printed circuit board 14 to which the cable 3 is soldered is placed at a predetermined location on the lower housing divided body 11B, and an outer covering, not shown, of the cable 3 is placed on the cable supporting portion 118 of the lower housing divided body 11B.

Next, the upper housing divided body 11A is placed over the lower housing divided body 11B.

Thereafter, the unlocking member body 20A of the unlocking member 20 is disposed on the upper housing divided body 11A. At this time, the supporting portion 114 and the restricting portion 115 are inserted through the holes 203 and 204 of the unlocking member body 20A, respectively.

Finally, the unlocking member-holding portion 13 and the shell 12 are mounted on the upper housing divided body 11A and the lower housing divided body 11B. As a consequence, the upper housing divided body 11A and the lower housing divided body 11B are bound to each other, and the unlocking member 20 is movably held by the housing 11.

Through the above-described working process, assembly of the connector 1 is completed.

Next, a description will be given of how to fit and remove the connector 1 to and from the mating connector 2.

When the connector 1 is fitted to the mating connector 2, a tip end of the elastic locking portion 21A of the mating connector 2 enters the opening 121 of the shell 12 of the connector 1, as shown in FIG. 7. At this time, the catching portion 123 of the shell 12 and the tip end of the elastic locking portion 21A are opposed to each other in the connector fitting direction DI. Therefore, even when an unexpected external force in the connector removing direction DS acts on the connector 1, the catching portion 123 catches the tip end off the elastic locking portion 21A, and hence the connector 1 and the mating connector 2 are maintained in a locked state. When the catching portion 123 catches the tip end of the elastic locking portion 21A, the area of contact between the catching portion 123 and the tip end of the elastic locking portion 21A is large, so that the locked state of the connector 1 and the mating connector 2 is prevented from being easily released, and is reliably maintained.

To remove the connector 1 from the mating connector 2, it is only required to pull the operation portion 20B of the unlocking member 20 in the connector removing direction DS. When the unlocking member 20 is pulled in the connector removing direction DS, the sliding portion 202 of the unlocking member 20 slides on the guide surface 114A of the supporting portion 114 of the housing 11, as shown in FIG. 8, whereby the releasing portion 201 is displaced toward the elastic locking portion 21A, and the spring piece 122 is elastically deformed. This causes the releasing portion 201 to push out the elastic locking portion 21A from the shell 12 via the spring piece 122. As a consequence, the elastic locking portion 21A is released from the state caught by the catching portion 123, thereby allowing the connector 1 to be pulled out from the mating connector 2.

With the above-described construction, when an unexpected external force in the connector removing direction DS acts on the connector 1, the locked state of the connector 1 and the mating connector 2 is prevented from being easily released. Further, the inclination angle of the guide surface 114A of the supporting portion 114 (angle formed by the guide surface 114A and the connector fitting direction DI) can be set as desired, and hence it is possible to reduce the inclination angle of the guide surface 114A, so that the operating force required to be applied to the unlocking member 20 when intentionally removing the connector 1 from the mating connector 2 can be prevented from becoming large. As a consequence, it is an easy operation to remove the connector 1 from the mating connector 2.

After the connector 1 has been pulled out from the mating connector 2, the unlocking member 20 is returned to its original position by the restoring force of the spring piece 122.

Note that when the unlocking member 20 is pulled in the connector removing direction DS, an inner peripheral surface of the hole 204 of the unlocking member body 20A of the unlocking member 20 is brought into abutment with the restricting portion 115 which restricts the unlocking member 20 from being moved relative to the connector body 10 beyond a predetermined amount in the connector removing direction DS. Further, when the unlocking member 20 is returned to its original position by the restoring force of the spring piece 122, the inner peripheral surface of the hole 204 of the unlocking member body 20A of the unlocking member 20 is brought into abutment with the restricting portion 115, which restricts the unlocking member 20 from being moved relative to the connector body 10 beyond the predetermined amount in the connector fitting direction DI.

According to the present embodiment, when an unexpected external force in the connector removing direction DS acts on the connector 1, it is possible to make it difficult to release the fitted state of the connector 1 and the mating connector 2, and when intentionally releasing the fitted state of the connector 1 and the mating connector 2, it is possible to remove the connector 1 from the mating connector 2 with a small operating force.

Further, when the connector 1 is fitted to the mating connector 2, the free end of the spring piece 122 is located between the elastic locking portion 21A of the mating connector 2 and the releasing portion 201 of the unlocking member 20, and hence when the unlocking member 20 is pulled in the connector removing direction DS, the position (power point) of the spring piece 122 to which the force from the releasing portion 201 is applied is far from the fixed end (support) of the spring piece 122. This reduces the operating force required to be applied to the unlocking member 20.

Furthermore, the housing 11 and the shell 12 are formed as separate members, and different materials can be used for the housing 11 and the shell 12, respectively. Therefore, it is possible to easily change the shape and magnitude of a tip end of the connector body 10.

Further, a rim of the hole 203 forms the sliding portion 202, and hence the thickness of the unlocking member 20 can be made smaller than when e.g. a protruding piece (not shown) which protrudes from the unlocking member body 20A is employed as a guide portion.

Next, a description will be given of a variation of the first embodiment shown in FIG. 1, with reference to FIG. 9.

The same components as those of the first embodiment shown in FIG. 1 are denoted by the same reference numerals, and description thereof is omitted. Hereafter, only main differences from the first embodiment shown in FIG. 1 will be described.

The connector 1 according to the first embodiment appearing in FIG. 1 is comprised of the connector body 10 and the unlocking member 20. The connector body 10 includes one shell 12 and one printed circuit board 14, and the unlocking member 20 includes one unlocking member body 20A.

Figure 9:
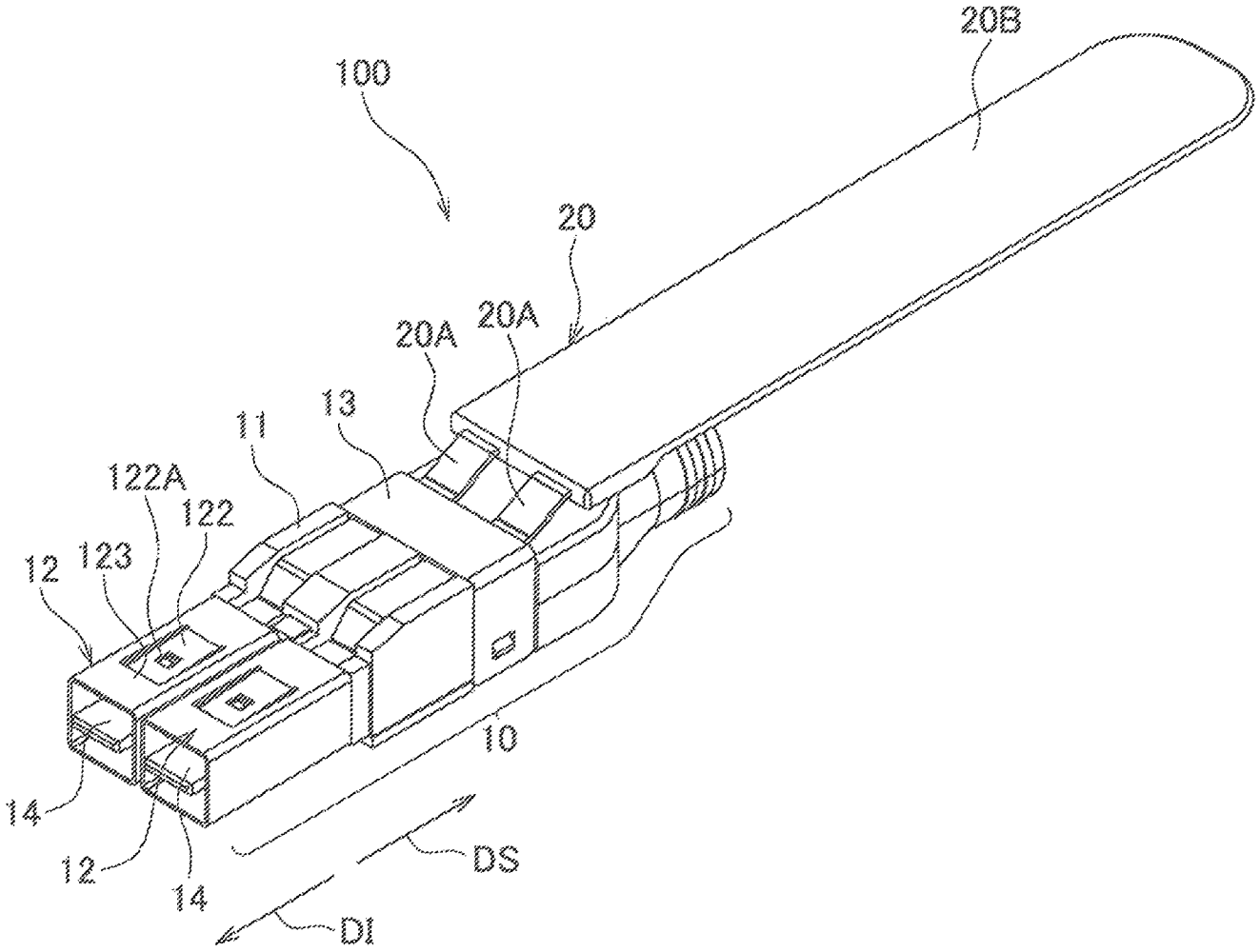
FIG. 9 is a perspective view of a connector according to a variation of the first embodiment of the present invention.

In contrast, in a connector 100 according to the variation shown in FIG. 9, the connector body 10 includes two shells 12 and two printed circuit boards 14, and the unlocking member 20 includes two unlocking member bodies 20A. The connector 100 according to the variation shown in FIG. 9 has substantially the same function as one formed by connecting two connectors 1 according to the first embodiment shown in FIG. 1. Therefore, the connector 100 according to this variation can be used as a connector for a cable including a large number of internal conductors.

Note that the respective numbers of the shells 12, the printed circuit boards 14, and the unlocking member bodies 20A may be three or more.

The variation shown in FIG. 9 provides the same advantageous effects as provided by the first embodiment shown in FIG. 1.

Figure 11:
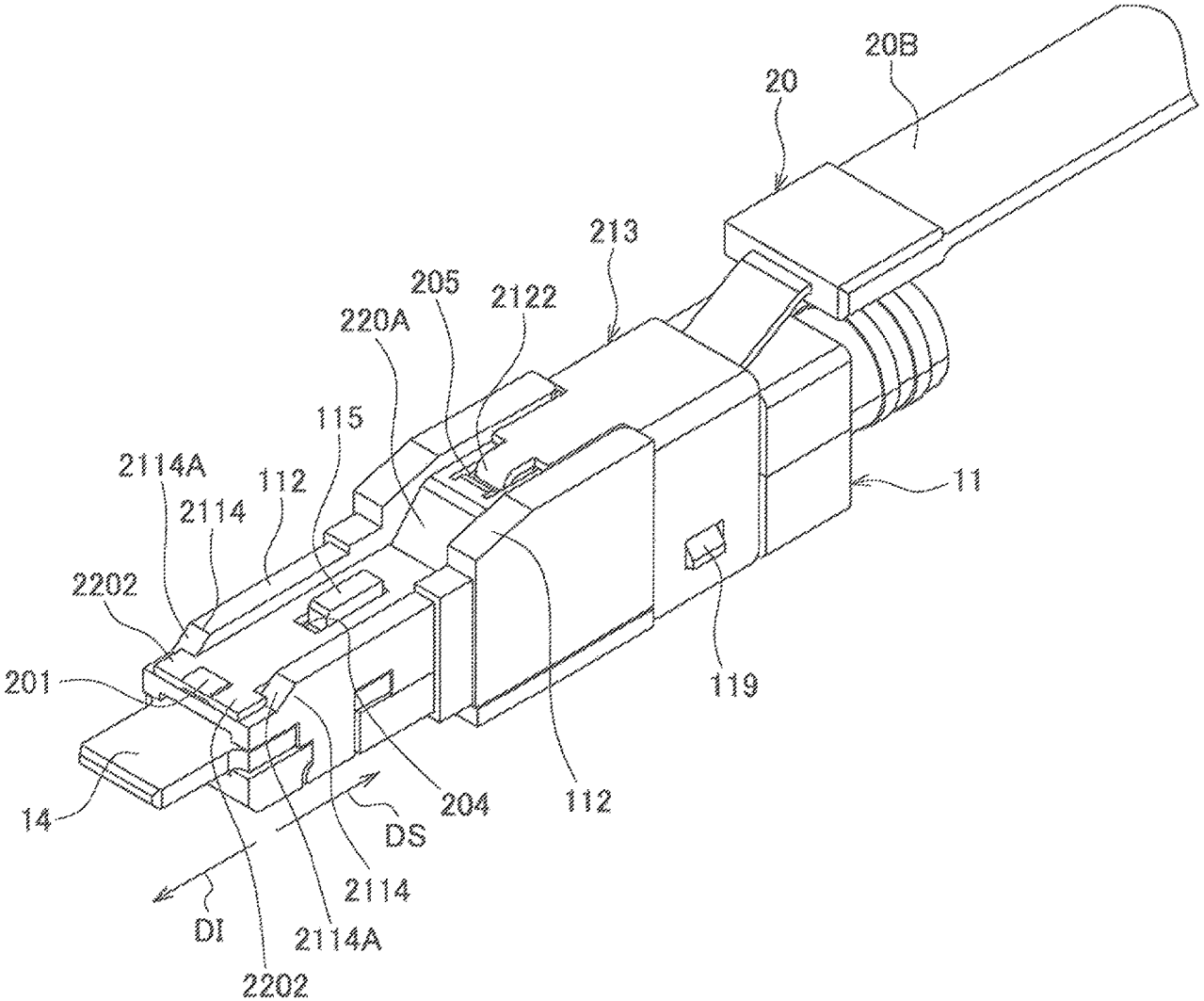
FIG. 11 is a perspective view of the connector shown in FIG. 10 in a state in which the shell is removed therefrom.
Figure 12:
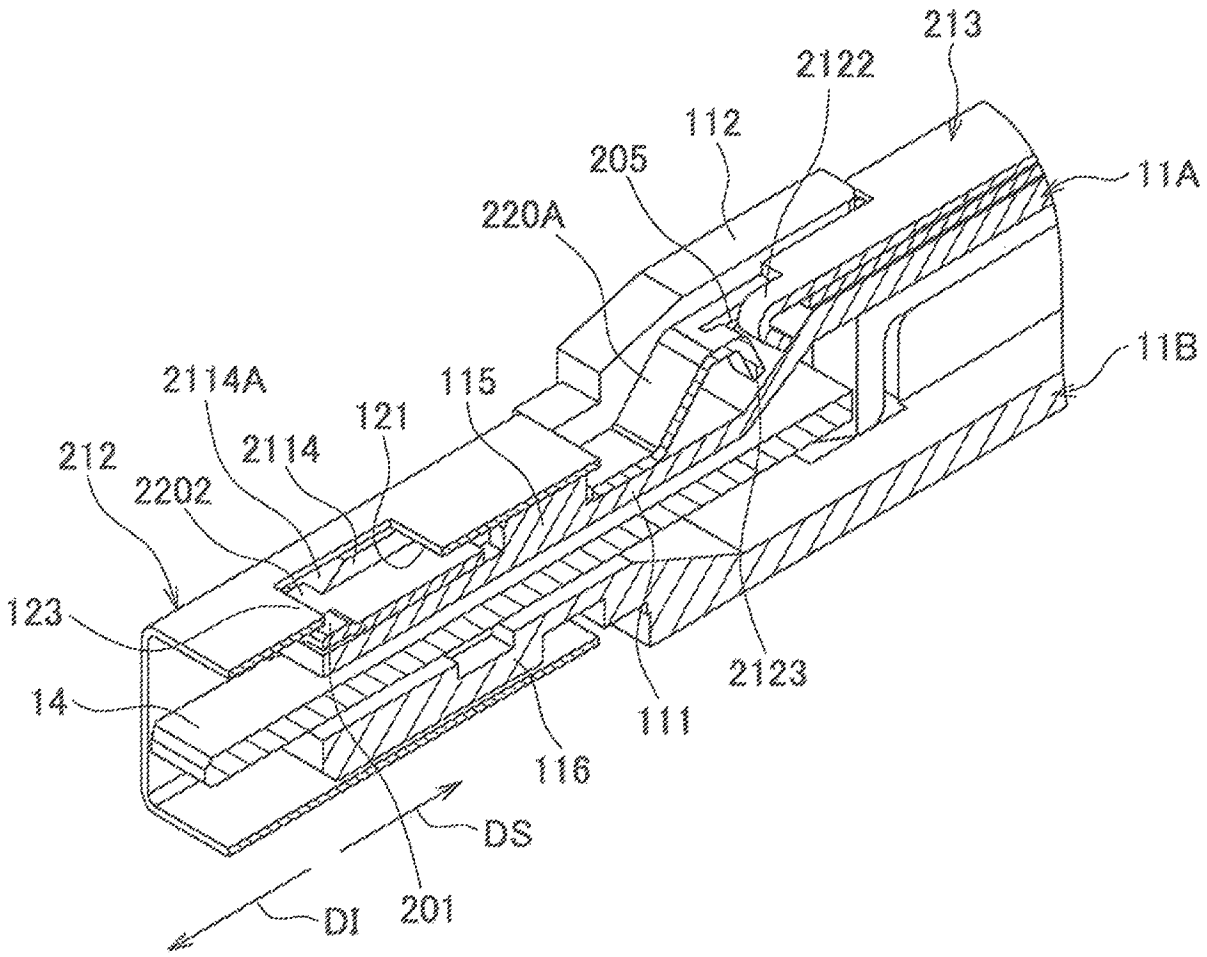
FIG. 12 is a cross-sectional view taken along X-X in FIG. 10.
Figure 13:
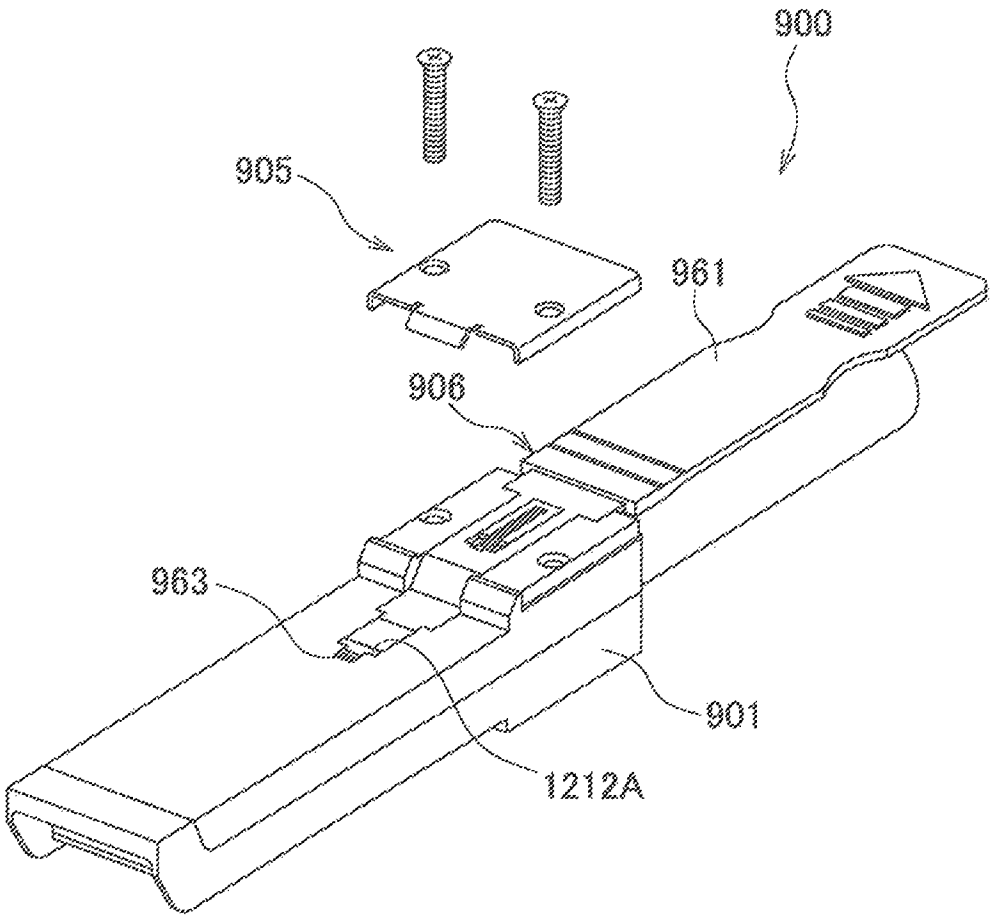
FIG. 13 PRIOR ART
FIG. 13 is a perspective view of a conventional electric connector assembly in a state in which a shielding member is removed therefrom.
Figure 14:
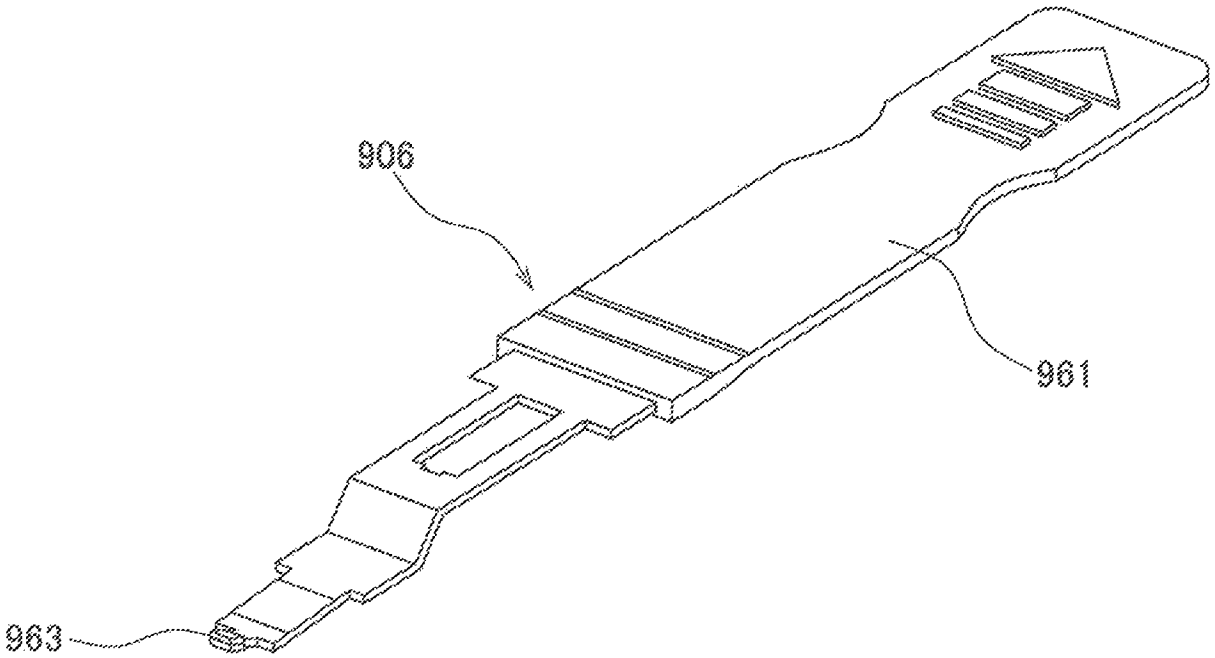
FIG. 14 PRIOR ART
FIG. 14 is a perspective view of a latch mechanism of the electric connector assembly shown in FIG. 13.
Figure 15:
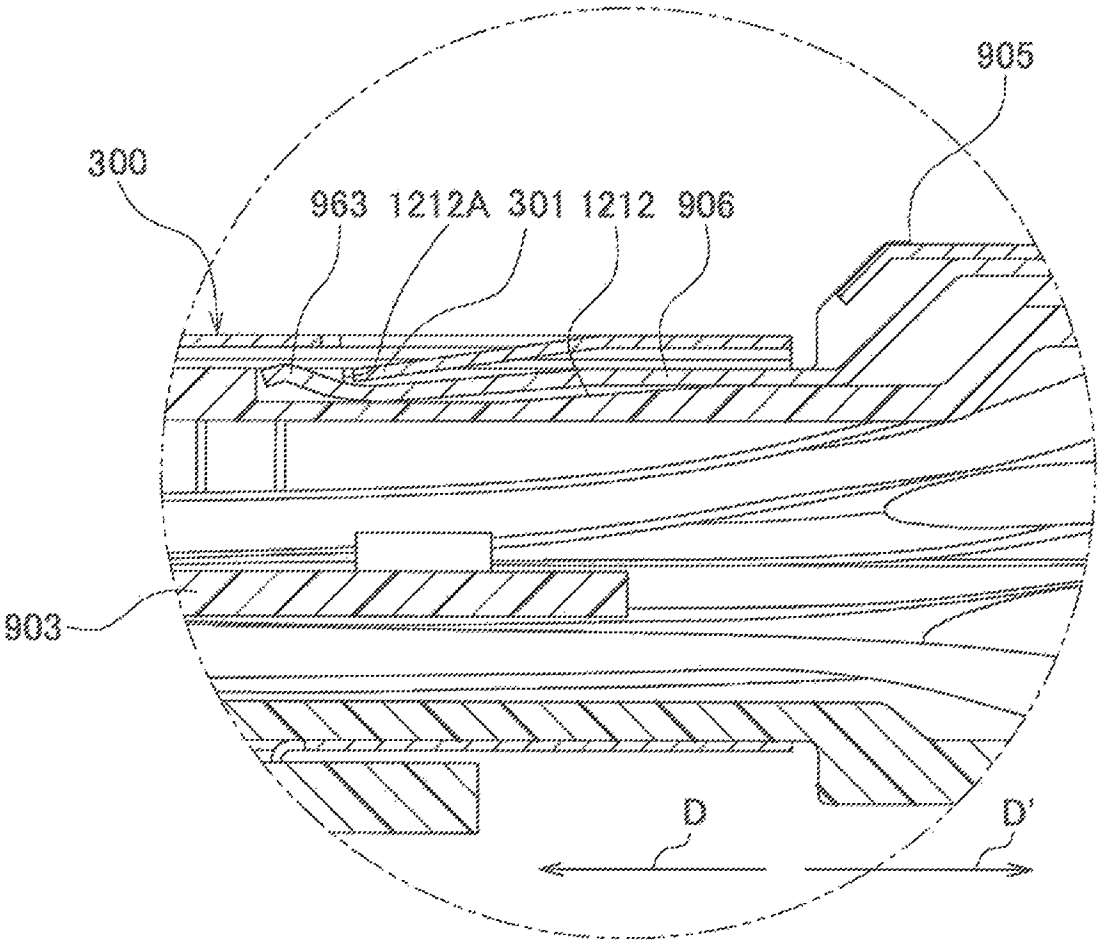
FIG.15 PRIOR ART
FIG. 15 is a partial enlarged cross-sectional view of the electric connector assembly shown in FIG. 13 in a state fitted to a receptacle connector.

Next, a description will be given of a connector 200 according to a second embodiment of the present invention, with reference to FIGS. 10 to 12.

The same components as those of the first embodiment shown in FIG. 1 are denoted by the same reference numerals, and description thereof is omitted. Hereafter, only main differences from the first embodiment shown in FIG. 1 will be described.

Different points between the second embodiment and the first embodiment shown in FIG. 1 are as follows:

In the connector 200 according to the present embodiment, a spring piece 2122, which returns the unlocking member 20 to its original position after the connector 200 has been pulled out from the mating connector 2, is formed not on a shell 212 but on an unlocking member-holding portion 213.

Further, supporting portions 2114 each having a guide surface 2114A are formed on respective front sides of the pair of side wall portions 112 in the connector fitting direction DI. Although an unlocking member body 220A of the unlocking member 20 is formed with the hole (restricting portion-receiving portion) 204 for receiving the restricting portion 115, the unlocking member body 220A is formed with no holes for allowing the supporting portions 2114 to enter. Sliding portions 2202 are located on respective opposite sides of the releasing portion 201 (left and right sides thereof in the connector fitting direction DI).

The unlocking member body 220A of the unlocking member 20 is formed with not only a hole 205 which allows the spring piece 2122 of the unlocking member-holding portion 213 to enter therethrough toward the upper wall portion 111 but also a protruding piece 2123 which is brought into contact with the spring piece 2122 of the unlocking member-holding portion 213 when the operation portion 20B of the unlocking member 20 is pulled in the connector removing direction DS.

After the connector 200 has been pulled out from the mating connector 2, the unlocking member 20 is returned to its original position by the restoring force of the spring piece 2122.

Figure 10:
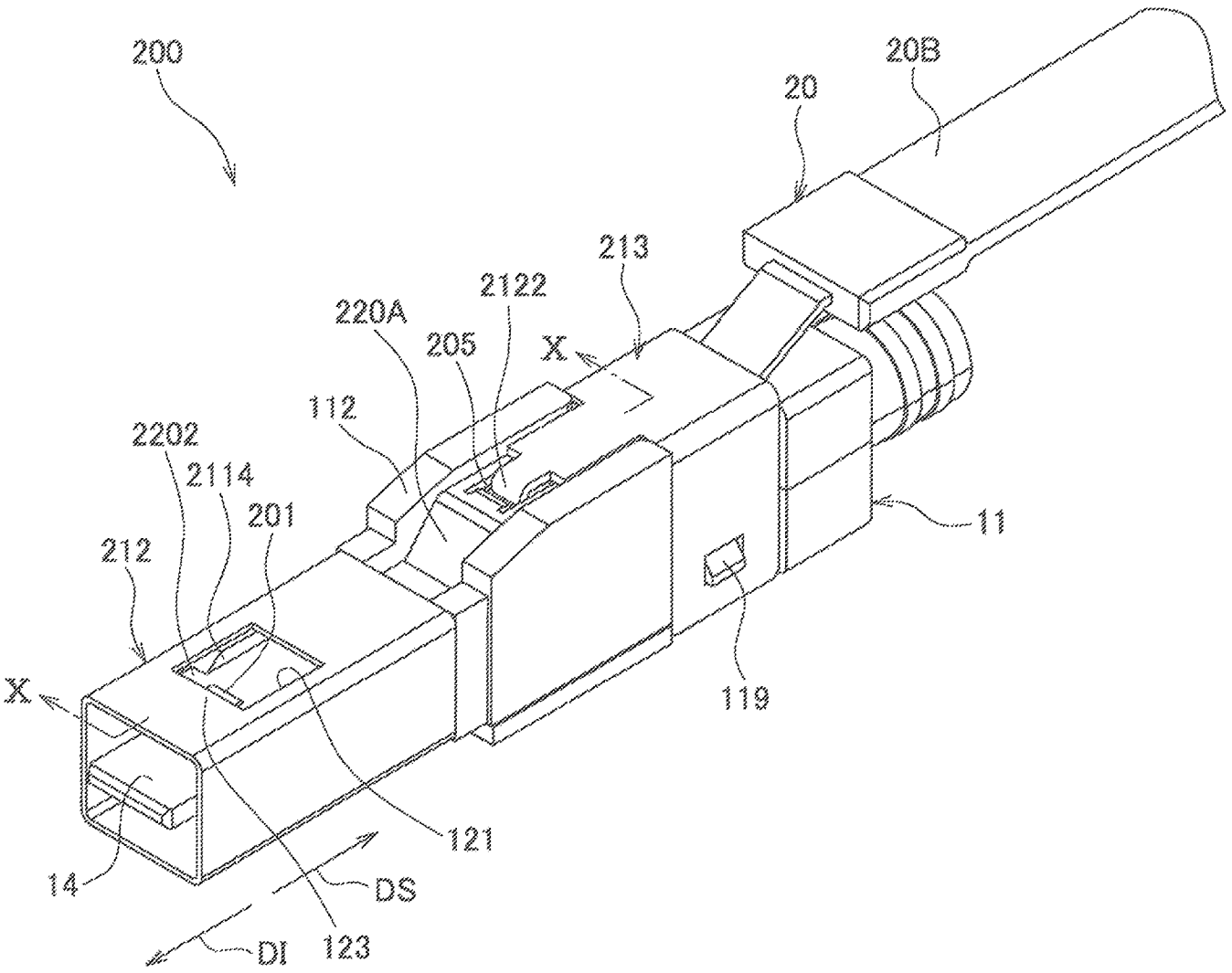
FIG. 10 is a perspective view of a connector according to a second embodiment of the present invention.

The second embodiment shown in FIG. 10 provides the same advantageous effects as provided by the first embodiment shown in FIG. 1.

Note that in the above-described embodiments, the guide surfaces 114A and 2114A for releasing the elastic locking portion 21A from the state caught by the catching portion 123 are formed on the supporting portions 114 and 2114, the guide surfaces may be formed on the sliding portions 202 and 2202, or on both the supporting portions 114 and 2114 and the sliding portions 202 and 2202, respectively.

Further, although in the above-described embodiments, the guide surfaces 114A and 2114A are substantially flat surfaces, they are not limited to flat surfaces, but may be curved (convex, concave, cylindrical or the like) surfaces.

Note that although the housing 11, the shells 12 and 212, the unlocking member-holding portions 13 and 213, and the unlocking member bodies 20A and 220A of the unlocking member 20 are all made of metal, they may be formed of resin.

Further, although the operation portion 20B of the unlocking member 20 is made of resin, the operation portion 20B may be formed of metal.

Note that although in the above-described embodiments, the shell 12 includes the spring piece 122, the spring piece 122 is not necessarily an element to be provided. The same applies to the spring piece 2122. Although in the above-described embodiments, the catching portion 123 is formed on the shells 12 and 212, a catching portion may be directly formed on the housing 11 instead of using the shells 12 and 212.

It is further understood by those skilled in the art that the foregoing are the preferred embodiments of the present invention, and that various changes and modification may be made thereto without departing from the spirit and scope thereof.

What is claimed is:

1. A connector comprising:

a connector body that can be fitted to a mating connector including an elastic locking portion; and an unlocking member that is mounted on the connector body in a manner movable in a connector fitting direction and a connector removing direction, for releasing the connector from a state fitted to the mating connector, wherein the connector body includes a catching portion that catches the elastic locking portion, for maintaining the connector in the state fitted to the mating connector, wherein the unlocking member includes:

a releasing portion for releasing the elastic locking portion from a state caught by the catching portion; and a sliding portion for sliding on the connector body, wherein the connector body includes a supporting portion that slidably supports the sliding portion when the unlocking member is pulled in the connector removing direction, wherein at least one of the supporting portion and the sliding portion has a guide surface formed thereon which is sloped such that the guide surface becomes closer to the elastic locking portion as the guide surface extends from a front side to a rear side of the connector body in the connector fitting direction, for guiding the sliding portion such that the releasing portion is displaced toward the elastic locking portion, to thereby cause the elastic locking portion to be released from the state caught by the catching portion, wherein the connector body includes:

a housing; and a shell that covers at least part of the housing, wherein the shell has an opening for allowing the elastic locking portion to be received therein, wherein a rim of the opening of the shell forms the catching portion, and wherein the shell has a spring piece which is cantilevered and extends with respect to the opening from a rear side to a front side in the connector fitting direction, and is elastically deformed by being pushed by the releasing portion when the unlocking member is pulled in the connector removing direction, to thereby push out the elastic locking portion from the shell.

2. The connector according to claim 1, wherein the supporting portion is located rearward of the releasing portion in the connector fitting direction, wherein the unlocking member includes a hole for allowing the supporting portion to enter therethrough toward the elastic locking portion, and wherein the sliding portion is located between the releasing portion and the hole in the connector fitting direction.

3. The connector according to claim 1, wherein the connector body includes an unlocking member-holding portion for holding the unlocking member on the housing in a manner movable in the connector fitting direction and the connector removing direction.

4. The connector according to claim 2, wherein the connector body includes an unlocking member-holding portion for holding the unlocking member on the housing in a manner movable in the connector fitting direction and the connector removing direction.

5. The connector according to claim 1, wherein the connector body includes a restricting portion which is located rearward of the supporting portion in the connector fitting direction, for restricting movement of the unlocking member in the connector fitting direction and the connector removing direction, and wherein the unlocking member includes a restricting portion-receiving portion which is located rearward of the sliding portion in the connector fitting direction, for receiving the restricting portion.

6. The connector according to claim 2, wherein the connector body includes a restricting portion which is located rearward of the supporting portion in the connector fitting direction, for restricting movement of the unlocking member in the connector fitting direction and the connector removing direction, and wherein the unlocking member includes a restricting portion-receiving portion which is located rearward of the sliding portion in the connector fitting direction, for receiving the restricting portion.

7. The connector according to claim 1, wherein the guide surface is a flat surface.

8. The connector according to claim 2, wherein the guide surface is a flat surface.

* * * * *